United States Patent [19]

Bellenberg et al.

[11] 4,058,230

[45] Nov. 15, 1977

[54] ARRANGEMENT FOR PNEUMATICALLY REGULATING THE INTRODUCTION OF SUBSTANCES INTO CHAMBERS

[75] Inventors: Heinz Bellenberg, Bottrop; Werner Kucharzyk, Essen; Wolfgang Rohde, Essen; Werner Siebert, Essen, all of Germany

[73] Assignees: Bergwerksverband GmbH; Didier Engineering GmbH, both of Essen, Germany

[21] Appl. No.: 662,017

[22] Filed: Feb. 27, 1976

[30] Foreign Application Priority Data

Mar. 8, 1975 Germany ..... 2510191

[51] Int. Cl.[2] ..... F23K 3/00

[52] U.S. Cl. ..... 214/18.2; 73/298

[58] Field of Search ..... 214/17 CA, 18.2; 137/403, 386; 73/290 R, 298

[56] References Cited

U.S. PATENT DOCUMENTS

| | | | |
|---|---|---|---|
| 2,642,206 | 6/1953 | Reed | 214/17 CA |
| 2,737,807 | 3/1956 | Brichard | 214/18.2 |
| 3,014,603 | 12/1961 | Taubmann | 214/18.2 |
| 3,200,971 | 8/1965 | Trethewey | 137/403 |
| 3,213,670 | 10/1965 | MacGeorge | 214/18.2 |

FOREIGN PATENT DOCUMENTS

| | | | |
|---|---|---|---|
| 1,240,782 | 9/1957 | France | 214/17 CA |

*Primary Examiner*—Robert J. Spar
*Assistant Examiner*—Lawrence E. Williams
*Attorney, Agent, or Firm*—Michael J. Striker

[57] ABSTRACT

An arrangement for regulating the introduction of substances into chambers is disclosed and is particularly well-suited for the feeding of coal into coke ovens. The arrangement includes a chamber which is to be filled to a predetermined level and a feeding device is provided for feeding material into the chamber. The feeding device has a switch which stops the introduction of the material to the chamber when the level of the material reaches the predetermined level. The switch for the feeding device is electrically connected with a differential pressure switch which is actuated upon the generating of a predetermined pressure differential across it. The requisite pressure differential is generated by introducing pressurized gas into the chamber and an air compressor may be provided for this purpose. A sensing conduit, which is connected with one terminal of the differential pressure switch, extends into the chamber and has an end positioned at the predetermined level to which the chamber is to be filled. The pressurized gas admitted into the chamber sets up certain pressure characteristics in the sensing conduit which are changed when the level of material in the chamber reaches the predetermined level so that the gas no longer has free access to the open end of the sensing conduit. The change in the pressure characteristics causes a pressure differential to be established across the differential pressure switch which, in turn, activates the feeding device switch to stop the introduction of material into the chamber. In order to compensate for shock waves which may be generated in the chamber by the feeding of the material and which may cause a false signal to be transmitted to the switch of the feeding device, a compensating conduit is provided which has an end in the chamber and is connected with the terminal of the differential pressure switch opposite that to which the sensing conduit is connected. A supply conduit for the pressurized gas is also provided and introduces the pressurized gas into the chamber in the vicinity of the end of the sensing conduit.

17 Claims, 2 Drawing Figures

ARRANGEMENT FOR PNEUMATICALLY REGULATING THE INTRODUCTION OF SUBSTANCES INTO CHAMBERS

BACKGROUND OF THE INVENTION

The invention relates generally to an arrangement for regulating the introduction of substances into chambers. Of particular interest to the invention is the introduction of particulate materials into chambers, and especially the feeding of coal into coke ovens.

A known arrangement for measuring and regulating the level of coal in coke ovens includes one or more pressure of sensing tubes which extend into an oven chamber or chambers. A predetermined gas pressure is maintained in such a pressure tube by passing a gas therethrough. A pressure switch is connected with the pressure tube and the pressure switch is, in turn, electrically connected with a switch for the transporting device which conveys the coal to the coke oven. The arrangement just described operates to pneumatically measure and regulate the level of the coal in the coke oven.

The pressure of sensing tube has an end located in the coke oven chamber at a predetermined level of the latter and, as indicated above, a certain gas pressure is maintained interiorly of this tube. The measuring principle of pneumatic devices for determining the filling level in coke ovens is generally based on the fact that the moist or preheated coal blocks the end of the sensing tube to at least some extent when, during the filling operation, the level of the coal reaches the level at which the end of the sensing tube is located. As a result, the gas flowing through the sensing tube which may, for instance, be air, is prevented from freely entering the coke oven chamber, that is, the flow of the gas is restricted at the outlet end of the sensing tube. This causes a backpressure to be generated, that is, this causes a pressure increase interiorly of the sensing tube.

A certain gas flow quantity is required in order that a pressure increase may be associated with the abovementioned blockage of the sensing tube. In addition, the end of the sensing tube must be immersed in the coal charge to a certain predetermined extent.

The pressure increase which may be achieved interiorly of the sensing tube is limited inasmuch as the charge surrounding the end of the sensing tube does not completely seal the sensing tube. Thus, only a certain, limited resistance to flow will be achieved for a given depth of penetration of the end of the sensing tube into the coal charge and gas will continue flowing out of the sensing tube into the coke oven chamber even after the end of the sensing tube is immersed in the coal charge. Upon exceeding a relatively low backpressure, for instance, a pressure corresponding to a water column of 100 millimeters where preheated coal is being charged, the gas pressure becomes sufficient to blow the end of the sensing tube free of coal and to thereby permit the gas, e.g., air, to freely flow into the coal charge. The critical pressure increase is still lower where moist coal is being charged. Here, the pressure corresponds to a water column of only about 20 millimeters. The low pressure increase achieved in the sensing tube, which pressure increase may also be referred to as the switching pressure, must suffice, when in the form of an impulse, to activate the subsequent switching operations such as, for example, those terminating the filling operating. For terminating the filling operation, the pressure increase must suffice to activate the abovementioned pressure switch which, in turn, operates the switch provided for the transporting device which conveys the coal to the coke oven.

The reason why the critical pressures for moist and preheated coals are different resides in that the bulk density of moist coal differs from that of preheated coal. The difference in bulk density is associated with the fact that the free spaces between the individual coal particles are of different size for moist and preheated coals. As a result, different pressures will be generated in a sensing tube for a given gas quantity, the pressure in the sensing tube corresponding to the bulk density of the coal being charged. A high bulk density results in a higher pressure and vice versa.

The measuring devices of the above type, which are intended to provide signals for the orderly filling of coke oven chambers via small regulating impulses as just described, possess certain disadvantages. A particularly severe disadvantage resides in the fact that pressure waves are generated in the coke oven chamber during the filling operation, especially at the beginning of the filling operation. These pressure waves are caused by the coal which is being charged into the coke oven chamber. The pressures associated with the pressure waves are of about the same magnitude as the switching pressures and, accordingly, the pressure waves do not only disturb the measuring procedure but make it impossible to carry this out.

Another disadvantage is associated with the fact that a certain predetermined quantity of gas, e.g., air, must be conveyed through the sensing tube in order to guarantee that the requisite pressure increase, that is, the switching pressure, is achieved. This requires that the supply pressure for the gas be adjusted to a level which approximates the magnitude of the switching pressure itself. As a result, the measuring procedure is made difficult, if not impossible, to carry out.

SUMMARY OF THE INVENTION

One subject of the invention is to provide a device and arrangement for regulating the introduction of substances into chambers which enable the effects of pressure waves generated in the chambers to be eliminated or at least virtually eliminated.

Another object of the invention is to provide a device and arrangement for regulating the introduction of substances into chambers which enable the effects of the gas supply pressure on the switching pressure to be avoided, at least to a great extent.

An additional object of the invention is to provide a pneumatic device for measuring or sensing the filling level in coke ovens which enables the disturbing effect of the pressure waves generated in a coke oven during the filling operation to be eliminated, which enables the counteraction of the gas supply pressure on the switching pressure to be aovided and which, simultaneously, enables a sure functioning of the measuring or sensing procedure to be insured.

These objects, as well as others which will become apparent as the description proceeds, are achieved in accordance with the invention. According to one aspect of the invention, there is provided an arrangement for regulating the introduction of substances into chambers, particularly for use in the feeding of particulate materials into chambers, which comprises a chamber to be filled with a substance to a predetermined level. Means is provided for feeding the substance into the chamber and switch means is provided for the feeding means. The switch means is operative for interrupting the introduction of the substance into the chamber in response to a signal generated when the substance fills the chamber to the predetermined level to which the chamber is to be filled. The switch means includes a differential pressure switch actuable in response to the generation of a predetermined pressure differential thereacross. The arrangement further includes means for admitting pressurized gas into the chamber so as to permit the generation of a pressure differential across the differential pressure switch. Means is also provided for transmitting pressure signals to the differential pressure switch. The transmitting means includes a sensing conduit connected with the differential pressure switch. The sensing conduit has an end portion arranged in the chamber at approximately the predetermined level to which the chamber is to be filled so as to permit the pressure characteristics generated in the sensing conduit due to the flow of the pressurized gas into the chamber to be changed and a corresponding signal to be transmitted to the differential pressure switch when the level of the substance in the chamber reaches the predetermined level. The transmitting means further includes a compensating conduit having an end portion in the chamber and also connected with the differential pressure switch. The compensating conduit is operative, in cooperation with the sensing conduit, for preventing unintentional actuation of the differential pressure switch due to pressure waves generated in the chamber by permitting cancellation of the pressure waves occurring across the differential pressure switch.

According to a particularly advantageous embodiment of the invention, the objects of the invention are achieved in that a compensating conduit is provided in addition to a measuring or sensing conduit which operates as a pressure conduit. The compensating conduit and sensing conduit are connected with one another exteriorily of the chamber, e.g., a coke oven chamber, via a differential pressure switch. A special or separate supply conduit is provided for the pressurized gas and is arranged to admit the pressurized gas into the sensing conduit at a location of the latter immediately adjacent the end or end portion of the sensing conduit which is located in the chamber. In the event that the sensing conduit extends downwardly into the chamber, the supply conduit is arranged to admit the pressurized gas into the sensing conduit immediately above the lower end or opening of the sensing conduit.

A very favorable embodiment of the invention contemplates for the sensing conduit and the compensating conduit to be arranged closely adjacent one another interiorly of the chamber, e.g., the oven chamber.

It is further advantageous within the concept of the invention for the compensating conduit, the sensing conduit and the gas supply conduit to be arranged concentrically within the chamber, e.g., the oven chamber, in such a manner that the compensating conduit surrounds the supply conduit which, in turn, surrounds the sensing conduit.

A further embodiment of the invention contemplates for the sensing conduit to be bent adjacent the end thereof which is located in the chamber.

According to an additional embodiment of the invention, the supply conduit surrounds the sensing conduit interiorly of the chamber and the lengths of the sensing conduit and the supply conduit interiorly of the chamber are about the same. The end of the supply conduit interiorly of the chamber is open and both the sensing conduit and the supply conduit are provided with a bend adjacent the respective ends thereof which are located in the chamber.

The technical advance achievable with the invention resides particularly in that an overall reliable measurement may be insured with a pneumatic measuring or sensing device according to the invention. This is achieved by virtue of simple and neat groupings and with the use of simple means.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

The invention relates, in a preferred aspect, to an arrangement for the pneumatic measurement and regulation of the filling level of coal in coking ovens. The preferred arrangement according to the invention is of the type which includes one or more pressure or sensing conduits and a pressure switch which is electrically connected with a switch or circuit breaker for the coal transporting device. The sensing conduit or conduits extend into an oven chamber and a certain pressure exists in the sensing conduit or conduits.

The description which follows will be with reference to the preferred application contemplated by the invention, namely, the charging of coal into coking ovens.

Figure 1:
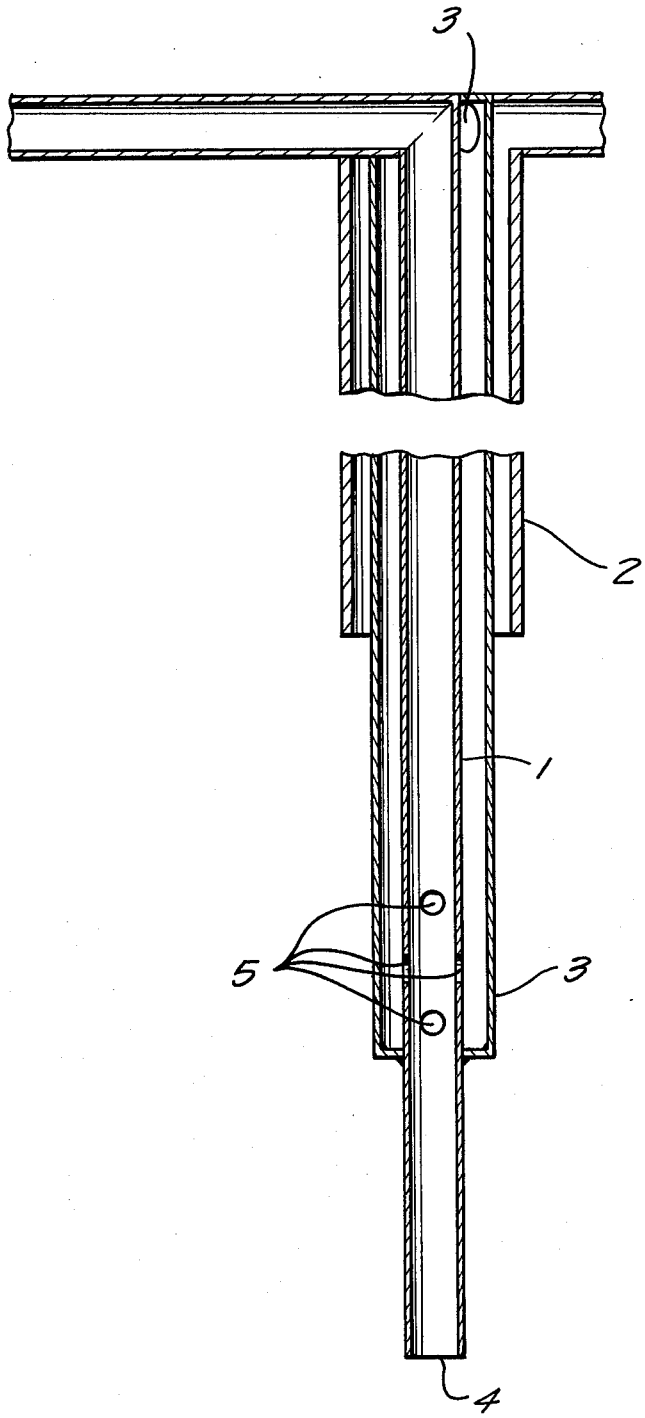
FIG. 1 is a partial schematic sectional view of one embodiment of a device in accordance with the invention.

Referring now to FIG. 1 of the drawing, it may be seen that this partially and schematically illustrates one embodiment of a device according to the invention which may be used for measuring and regulating the introduction of a coal into coking ovens. The device includes a sensing conduit 1 having an open end 4 which, in operation of the device, is located interiorly of a coke oven chamber. Usually, the sensing conduit 1 will extend downwardly into the oven chamber and, hence, the open end 4 of the sensing conduit 1 will also be referred to here as the lower end of the sensing conduit 1. The sensing conduit 1 also has another end which is not shown in FIG. 1 and which, in operation of the device, is located exteriorly of the coke oven chamber and is connected with a differential pressure switch which has also not been shown in FIG. 1.

The sensing conduit 1 is surrounded by a gas supply conduit 3 through which a pressurized gas such as, for instance, pressurized air, is conveyed. The end of the supply conduit 3 which is located in the oven chamber and faces tha charge in the chamber, that is, the end of the supply conduit 3 nearest the open end 4 of the sensing conduit 1, is circumferentially closed. Openings 5 are provided in the common wall between the sensing conduit 1 and the supply conduit 3 so that the interior of the sensing conduit 1 communicates with the interior of the supply conduit 3. The openings 5 are provided in the immediate region of the open end 4 of the sensing conduit 1.

The supply conduit 3 has another end remote from that near which the openings 5 are provided in the illustrated embodiment. This other end of the supply conduit 3, which has not been shown in FIG. 1, is connected with a compressor which has likewise not been illustrated in FIG. 1.

The supply conduit 3 is surrounded by a compensating conduit 2 interiorly of the coke oven chamber. The compensating conduit 2 is here assumed to have an annular configuration. The compensating conduit 2 has an end, shown in FIG. 1, which is located interiorly of the coke oven chamber and another end, not illustrated in FIG. 1, which is located exteriorly of the coke oven and is connected with the previously mentioned differential pressure guage, namely, the differential pressure guage with which the sensing conduit 1 is connected. The sensing conduit 1 and the compensating conduit 2 are connected to opposite sides or poles of the differential pressure switch.

The sensing conduit 1, the compensating conduit 2 and the supply conduit 3 are concentrically arranged in FIG. 1. As is clear from FIG. 1, the sensing conduit 1 is centrally positioned within the concentric arrangement.

The course of a measuring procedure is as follows: The pressure waves generated by the falling coal during a process of charging or filling a coke oven or coke oven chamber are corrected for in that the compensating conduit 2 is located in the oven chamber in addition to the sensing conduit 1. The pressure waves, which affect the actual measuring or sensing operation in the prior art, here simultaneously travel to the two sides of the differential pressure switch via the sensing conduit 1 on the one hand and the compensating conduit 2 on the other hand. As a result, the pressure waves are mutually compensated for. In this manner, it is possible to insure that a falsified switching pressure is not transmitted to the switching devices beyond the differential pressure switch whereas a non-falsified or true switching pressure is transmitted to the switching devices beyond the differential pressure switch via the latter.

On the other hand, the counteraction of the gas supply pressure on the switching pressure may be avoided in that the pressurized gas is conveyed through a separate conduit 3 to a location immediately adjacent the lower end 4 of the sensing conduit 1 and is first admitted into the sensing conduit 1 proper at this location. This measure permits any arbitrary flow losses and gas supply pressures to exist within the limits of the gas quantities which are required without any substantial influence on the pressure characteristics interiorly of the sensing conduit 1 arising therefrom. It is only when the sensing conduit 1 becomes immersed in the coal charge that an increase in pressure occurs at the lower open end 4 of the sensing conduit 1. This pressure increase quickly travels to the differential pressure switch and signals the presence of the corresponding switching pressure.

Referring once again to the construction of a device according to the invention, it is pointed out that another embodiment of the invention contemplates for the sensing condiut 1 of FIG. 1 to be connected with the compressor and to serve as a gas supply conduit whereas the conduit 3 which previously served as a gas supply conduit is connected with the differential pressure switch. This embodiment of the device possesses the advantage that, even if relatively large quantities of pressurized gas are supplied, the supply pressure is almost zero. Thus, the gas is accelerated by the compressor and flows out of the conduit 1 without having to undergo a change in direction as is the case when the gas is supplied via the conduit 3 and must change direction upon flowing into the conduit 1 via the openings 5. Due to the fact that the gas accelerated by the compressor flows out of the conduit 1 without undergoing a change in direction, it is only the static pressure at the locations of the openings 5 which is measured through the latter via the conduit 3. In the first embodiment described, namely, the embodiment where the conduit 1 serves as a sensing conduit and the conduit 3 serves as a gas supply conduit, it is the dynamic pressure which is measured since, due to the change in direction of the gas stream, there is additionally generated in the conduit 1 the pressure for accelerating the gas in the new direction.

A further embodiment which falls within the scope of the invention resides in that the conduits, and particularly the sensing conduit 1 and the compensating conduit 2, are arranged immediately adjacent, yet separate from, one another.

According to still another embodiment of the invention, the gas supply conduit 3 surrounding the sensing conduit 1 has the same length as the sensing conduit 1 and is constructed with an open end. In other words, the lengths of the sensing conduit 1 and the gas supply conduit 3 interiorly of the oven chamber are about the same and the end of the supply conduit 3 located interiorly of the oven chamber is open. The advantage of this embodiment resides in that absolutely no supply pressure, which latter is dependent upon the flow quantity of the pressurized gas or air, is generated in the sensing conduit 1. This is particularly advantageous since, upon the introduction of the device into an oven chamber which is heated to 1000° C or so, the conduits and, concomitantly, the gas quantities within the conduits, are strongly heated. The heating causes a volume change of the gas which is accompanied by a change in the flow quantity of the gas. The change in the gas flow quantity in turn affects the supply pressure. The present embodiment makes it possible to avoid in the sensing conduit 1 the changes in supply pressure occasioned by changes in the gas flow quantity inasmuch as the present embodiment makes provision for supplying the pressurized gas entirely through the gas supply conduit 3. A pressure increase in the sensing conduit 1 first occurs when the annular gas stream flowing out of the gas supply conduit 3 surrounding the sensing conduit 1 impinges the coal charge. The backpressure which is generated thereby creates the requisite switching pressure in the sensing conduit 1.

Figure 2:
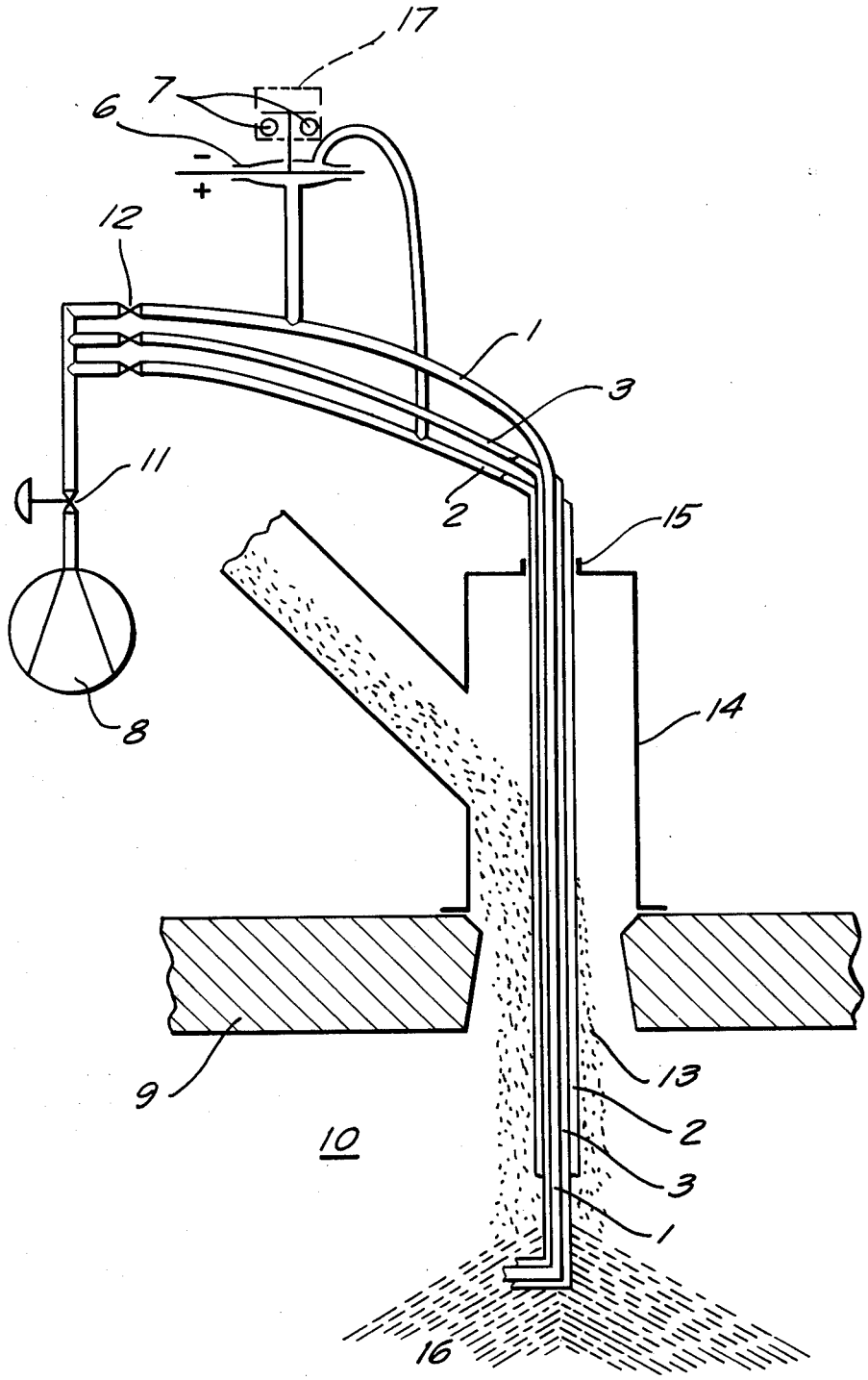
FIG. 2 schematically illustrates an arrangement according to the invention which includes another embodiment of a device in accordance with the invention.

FIG. 2 of the drawing illustrates a device according to the invention in use during a filling operation and, in particular, during the feeding of coal into a coke oven chamber. The same reference numerals as in FIG. 1 have been used to designate similar components in FIG. 2 and it is pointed out that the device in FIG. 2 comprising the conduits 1, 2 and 3 has a construction corresponding to the last-mentioned embodiment of the invention but with somewhat of a variation as will be discussed more fully below.

FIG. 2 shows a coke oven chamber 10 having a wall 9 and the wall 9 is provided with an opening 13 for the introduction of coal into the chamber 10. A feeding member 14 is positioned astride the filling opening 13 and coal is fed into the feeding member 14 via a charging device 18 which may, for instance, be in the form of a transporting device for conveying the coal to the chamber 10. The coal passes downwardly through the feeding member 14 into the chamber 10 via the filling opening 13. The coal admitted into the chamber 10 forms a pile 16 therein.

The feeding member 14 has an opening provided with a bushing 15 and the device according to the invention comprising the conduits 1, 2 and 3 sealingly extends through the bushing 15 and into the chamber 10 via the feeding member 14 and the filling opening 13. The lower end of the device, that is, the lower end of the sensing conduit 1, is arranged so as to be positioned at approximately that level of the chamber 10 to which it is desired to fill the chamber 10.

The conduits 1, 2 and 3 are connected with a compressor 8 via valves 12 of which one is provided in each of the conduits 1, 2 and 3. The compressor 8 services to convey the pressurized gas used for sensing the level of the coal in the chamber 10 into the latter. The pressurized gas is here assumed to be compressed air. The valves 12 permit the quantity of air admitted into the chamber 10 to be adjusted to the valve required for sensing the level of the coal in the chamber 10. An expansion valve 11 is provided intermediate the compressor 8 and the valves 12 and the expansion valve 11 makes it possible to regulate the pressure of the compressed air so that this remains uniform.

The sensing conduit 1 and the compensating conduit 2 are each provided with a branch intermediate the chamber 10 and the respective valves 12. The branches of the sensing conduit 1 and the compensating conduit 2 lead to a differential pressure switch 6. The branch of the sensing conduit 1 communicates with what is indicated as the plus side or pole of the differential pressure switch 6 whereas the branch of the compensating conduit 2 communicates with what is indicated as the minus side or pole of the differential pressure switch 6.

The differential pressure switch 6 is connected with an electrical switch 17 which cooperates with a pair of contacts 7. The electrical switch 17 and the contacts 7 are, in turn, located in an electrical circuit which leads to the charging device 18. An upward movement of the membrane of the differential pressure switch 6 is carried over to the electrical switch 17 and causes the latter to break the contact of the contacts 7. This results in the generation of an electrical signal which interrupts the introduction of coal into the chamber 10 by the charging device 18.

In operation, the compressor 8 conveys compressed air into the chamber 10. Coal is charged into the chamber 10 by the charging device 18. As long as the level of the coal in the chamber 10 is below that at which the lower ends of the sensing conduit 1 and the gas supply conduit 3 are located, no backpressure or pressure increase is generated in the supply conduit 3 and the sensing conduit 1 since the compressed air flows freely into the chamber. Any pressure waves created in the chamber 10 by the falling coal are transmitted to the opposite sides of the differential pressure switch 6 via the sensing conduit 1 and the compensating conduit 2. The pressure waves thus are compensated for across the differential pressure switch 6 so that the latter is not actuated and, hence, does not interrupt the introduction of coal into the chamber 10, in response to the pressure waves.

The air flowing through the device first experiences a backpressure or pressure increase when, as is illustrated in FIG. 2, the ends of the sensing conduit 1 and the supply conduit 3 become immersed in the coal pile 16, that is, when the level of the coal in the chamber 10 reaches the level at which the ends of the sensing conduit 1 and the supply conduit 3 are positioned. As soon as the sensing conduit 1 and the supply conduit 3 extend into the coal pile 16, a pressure increase is generated in the sensing conduit 1. The pressure increase is enhanced by the air which continues to flow out of the gas supply conduit 3. This pressure increase is transmitted to the plus side of the differential pressure switch 6 via the branch of the sensing conduit 1 which leads thereto. On the other hand, the minus side of the differential pressure switch 6 does not experience a pressure increase inasmuch as this is connected with the compensating conduit 2 and the end of the latter is not immersed in the coal pile 16.

Due to the fact that a higher pressure now exists at the plus side of the differential pressure switch 6 than at the minus side thereof, the membrane of the differential pressure switch 6 is displaced upwardly. This motion of the membrane is carried over to the electrical switch 17 which, in turn, brakes the contact of the contacts 7. An electrical signal results and is transmitted to the charging device 18 thereby causing an interruption in the introduction of coal into the chamber 10.

In the embodiment of FIG. 2, the end of the sensing conduit 1 located in the chamber 10 is provided with a bend as is the end of the supply conduit 3 located in the chamber 10. Although the bends have here been shown as being in the form of right-angled bends, this need not necessarily be so and the sensing conduit 1 and supply conduit 3 may be bent to other than right angles. It is also pointed out that a bend could be provided in the embodiment of FIG. 1 but that, in this case, it is advantageously only the sensing conduit 1 which is provided with a bend.

The provision of a bend in the sensing conduit 1, or bends in the sensing conduit 1 and the supply conduit 3, provides the advantage that the switching pressure, that is, the pressure increase necessary to activate the differential pressure switch 6 and the electrical switch 17, may be achieved with smaller quantities of the pressurized gas than would be necessary otherwise. This effect has been observed in practice. The explanation therefor is currently based on the assumption that, for the embodiments without a bend or bends, the kinetic energy of the gas flowing into the chamber 10 causes the formation of a hollow space or cavity in the coal pile 16 which is elongated in the direction of flow of the gas and which has such a stable arch that no collapse occurs. Accordingly, the resistance to flow is lower than that which would be achieved in the absence of a hollow space or cavity. On the other hand, it may be assumed that no arch is formed when the gas flows out of the sensing conduit 1 or the supply conduit 3 at an angle to the direction of elongation of the respective conduit so that the coal is positioned directly in front of the open end of the respective conduit. As a result, a higher resistance to flow is occasioned than would be the case in the presence of a cavity.

It has been mentioned earlier that the critical pressures for moist and preheated coals are different due to the fact that the bulk density of moist coal differs from that of preheated coal. The difference in bulk density is associated with the fact that the free spaces between the individual coal particles are of different size for moist and preheated coals. As a result, different pressures will be created in the sensing conduit 1 for a given flow quantity of gas through a device according to the invention, the pressure in the sensing conduit 1 corresponding to the bulk density of the coal being charged. A high bulk density results in a higher pressure and vice versa. It is possible to achieve the same pressures in the sensing conduit 1 for coal charges of different bulk density but, in order to achieve this, the quantity of pressurized gas delivered via the supply conduit 3 must normally be changed, that is, larger quantities of air will normally be required for lower bulk densities.

It will be understood that each of the elements described above, or two or more together, may also find a useful application in other types of constructions and operations differing from the types described above.

While the invention has been illustrated and described as embodied in a device and an arrangement for pneumatically regulating the introduction of coal into coke ovens, it is noted intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A particulate level sensing arrangement particularly for use in the regulating of the level of coal in a coke oven comprising a chamber which is to be filled with solid particles to a predetermined level; means for feeding the solid particles into said chamber; switch means for said feeding means operative for interrupting the introduction of the solid particles into said chamber in response to a signal generated when the solid particles fill said chamber to said predetermined level, said switch means including a differential pressure switch actuable is response to the generation of a predetermined pressure differential thereacross, said differential pressure switch having two opposing terminals; means for admitting pressurized gas into said chamber so as to permit the generating of a pressure differential across said differential pressure switch; and means for transmitting pressure signals to said differential pressure switch, said transmitting means including a sensing conduit connected with one terminal of said differential pressure switch and having an end portion arranged in said chamber at approximately said predetermined level so as to permit the pressure characteristics generated in said sensing conduit due to the flow of pressurized gas into said chamber to be changed and a corresponding signal to be transmitted to said differential pressure switch when the level of the solid particles in said chamber reaches said predetermined level, and said transmitting means also including compensating means operative in cooperation with said sensing conduit for preventing unintentional actuation of said differential pressure switch by counterbalancing at the other terminal of said differential pressure switch the effect upon said one terminal of pressure waves generated during filling of said chamber with said solid particles.

2. An arrangement as defined in claim 1, wherein said admitting means is arranged to admit pressurized gas into said chamber in the region of said end portion of said sensing conduit.

3. An arrangement as defined in claim 1, said compensating means comprising compensating conduit means operative in cooperation with said sensing conduit for directing the pressure waves simultaneously to the opposite terminals of said differential pressure switch, said conduit means having an end portion connected with said other terminal.

4. An arrangement as defined in claim 3, wherein said admitting means comprises a supply conduit extending into said chamber.

5. An arrangement as defined in claim 4, said chamber being a coke oven chamber, and said sensing conduit extending downwardly into said coke oven chamber; and wherein said feeding means comprises a transporting device for conveying coal to said coke oven chamber and said switch means includes a switch for said transporting device which is in electrical communication with said differential pressure switch, said supply conduit being arranged to admit pressurized gas into said sensing conduit immediately above said end portion of said sensing conduit.

6. An arrangement as defined in claim 4, said supply conduit having an end portion in said chamber and being arranged to admit pressurized gas into said sensing conduit in the vicinity of said end portion of said sensing conduit; and wherein said end portion of said supply conduit is closed and said sensing conduit is provided with openings communicating with the interior of said supply conduit so as to permit flow of pressurized gas from said supply conduit into said sensing conduit.

7. An arrangement as defined in claim 4, said supply conduit having an end portion in said chamber and being arranged so as to permit pressurized gas to flow from said supply conduit into said sensing conduit in the vicinity of said end portion of said sensing conduit; and wherein said end portion of said sensing conduit is closed and said supply conduit is provided with openings communicating with the interior of said sensing conduit so as to permit flow of pressurized gas from said supply conduit into said sensing conduit.

8. An arrangement as defined in claim 4, wherein said sensing conduit, said compensating conduit and said supply conduit are concentrically arranged interiorly of said chamber.

9. An arrangement as defined in claim 8, wherein said compensating conduit surrounds said supply conduit and said supply conduit surrounds said sensing conduit.

10. An arrangement as defined in claim 4, said supply conduit having an end portion interiorly of said chamber; and wherein said supply conduit surrounds said sensing conduit interiorly of said chamber and the lengths of said supply conduit and said sensing conduit interiorly of said chamber are approximately equal, said end portion of said supply conduit being open so as to permit the flow of pressurized gas into said chamber through said end portion of said supply conduit.

11. An arrangement as defined in claim 4, said supply conduit having an end portion in said chamber; and wherein said sensing conduit and said supply conduit are each provided with a bend in the regions of the respective end portions thereof.

12. An arrangement as defined in claim 1, wherein said sensing conduit is provided with a bend in the region of said end portion thereof.

13. An arrangement as defined in claim 1, wherein said sensing conduit and said compensating conduit are arranged adjacent one another interiorly of said chamber.

14. An arrangement as defined in claim 1, said admitting means comprising a supply conduit arranged to admit the pressurized gas into said chamber through said sensing conduit, said supply conduit communicating with the interior of said sensing conduit at a position immediately above the end portion of said sensing conduit.

15. An arrangement as defined in claim 1, said admitting means being operative for admitting pressurized gas within said chamber while preventing, in said sensing conduit, flow obstructions caused by gas volume changes following contact with heat in said chamber, said admitting means comprising a supply conduit through which the pressurized gas is entirely supplied, said supply conduit having the same length as said sensing conduit and being constructed with an open end located interiorly of said chamber.

16. An arrangement as defined in claim 1, wherein said supply conduit blows a stream of pressurized gas horizontally through said chamber.

17. A particulate level sensing arrangement particularly for use in the regulating of the level of coal in coke ovens, comprising a chamber which is to be filled with solid particles to a predetermined level; means for feeding the solid particles into said chamber; switch means for said feeding means operative for interrupting the introduction of the solid particles into said chamber in response to a signal generated when the solid particles fill said chamber to said predetermined level, said switch means including a differential pressure switch actuable in response to the generation of a predetermined pressure differential thereacross, said differential pressure switch having two opposing terminals; means for admitting pressurized gas into said chamber so as to permit the generating of a pressure differential across said differential pressure switch, said means comprising a first conduit having an end portion arranged in said chamber at approximately said predetermined level; and means for transmitting pressure signals to said differential pressure switch, said transmitting means including a second conduit surrounding said first conduit and communicating with said first conduit through openings connected with said differential pressure switch, said transmitting means operable in cooperation with said admitting means for measuring only static pressure at the locations of the openings and transmitting a corresponding signal to said differential pressure switch when the level of the solid particles in said chamber reaches said predetermined level.

* * * * *